US007205875B2

(12) United States Patent
Oughton, Jr. et al.

(10) Patent No.: US 7,205,875 B2
(45) Date of Patent: Apr. 17, 2007

(54) HYBRID AIR/MAGNETIC CORE INDUCTOR

(75) Inventors: George W. Oughton, Jr., Raleigh, NC (US); Lei Winston Zeng, Raleigh, NC (US); Larry Van Lynam, Youngsville, NC (US)

(73) Assignee: Eaton Power Quality Corporation, Cleveland, OH (US)

( * ) Notice: Subject to any disclaimer, the term of this patent is extended or adjusted under 35 U.S.C. 154(b) by 121 days.

(21) Appl. No.: 10/846,244

(22) Filed: May 14, 2004

(65) Prior Publication Data

US 2004/0263305 A1 Dec. 30, 2004

Related U.S. Application Data

(60) Provisional application No. 60/482,806, filed on Jun. 26, 2003.

(51) Int. Cl.
*H01F 27/08* (2006.01)
*H01F 27/10* (2006.01)

(52) U.S. Cl. ..... 336/60; 336/61; 336/58

(58) Field of Classification Search ..... 336/55, 336/58–62, 208, 198, 192
See application file for complete search history.

(56) References Cited

U.S. PATENT DOCUMENTS

| | | | | |
|---|---|---|---|---|
| 3,447,112 | A | 5/1969 | Broverman et al. | |
| 3,713,061 | A | 1/1973 | Weber | |
| 4,173,747 | A | 11/1979 | Grimes et al. | |
| 4,521,954 | A * | 6/1985 | Rademaker et al. | 29/605 |
| 4,546,210 | A * | 10/1985 | Akiba et al. | 174/114 R |
| 4,715,233 | A * | 12/1987 | Neven et al. | 73/861.12 |
| 5,473,302 | A * | 12/1995 | Terlop et al. | 336/183 |
| 5,477,007 | A | 12/1995 | Jagersberger | |
| 5,508,674 | A * | 4/1996 | Girgis et al. | 336/187 |
| 6,249,204 | B1 * | 6/2001 | Larranaga et al. | 336/198 |
| 6,593,839 | B2 * | 7/2003 | Nakayama et al. | 336/182 |

FOREIGN PATENT DOCUMENTS

| | | | |
|---|---|---|---|
| DE | 101 14 744 | A1 | 3/2001 |
| EP | 0 049 382 | A1 | 4/1982 |
| EP | 0 264 611 | A1 | 9/1987 |
| JP | 57143812 | A * | 9/1982 |
| JP | 09069446 | A * | 3/1997 |
| WO | WO 95/23420 | | 8/1995 |
| WO | WO 98/34238 | | 8/1998 |

OTHER PUBLICATIONS

Notification of Transmittal of the International Search Report and the Written Opinion of the International Searching Authority, or the Declaration, PCT/US2004/019896, Nov. 4, 2004.

* cited by examiner

*Primary Examiner*—Anh Mai
(74) *Attorney, Agent, or Firm*—Myers Bigel Sibley & Sajovec PA

(57) ABSTRACT

An inductor includes an elongate magnetic core, a coil wrapped around the core and a spacer that separates the coil from the core to provide a coolant passage between the coil and the core. The coolant passage may include an air passage that extends substantially parallel to an axis of the core and that has first and second openings proximate respective first and second ends of the core. The coil may include a twisted bundle of individually insulated conductors. The inductor may be housed in a flux-tolerant compartment, i.e., a conductive aluminum structure that supports eddy currents with relatively acceptable resistive losses.

10 Claims, 6 Drawing Sheets

HYBRID AIR/MAGNETIC CORE INDUCTOR

RELATED APPLICATION

The present application claims priority from U.S. Provisional Application Ser. No. 60/482,806, filed Jun. 26, 2003, the disclosure of which is hereby incorporated by reference in its entirety.

BACKGROUND OF THE INVENTION

The present invention relates to electromagnetic devices, and more particularly, to inductors.

A high power converter application, such as a PWM-based uninterruptible power supply (UPS), may require low inductance/high current inductors for power conversion circuits, such as rectifiers and inverters. In such an application, it may be desirable to maintain useful inductance to ~3 times rms rated current. Operational currents may include both a 50/60 Hz power component and high frequency ripple currents.

Conventional inductor designs include closed flux path and gapped (discrete & distributed) core designs. Torroidal designs may require a complex winding design, and core heat may be trapped inside such a complex winding. Winding heat may further add to core temperature, and inner winding layers may be difficult to keep cool in such designs. Gapped EE/EI or UU/UI designs often include a large core volume with a large air gap. Difficulties in cooling often drives toward the use of a ferrite core, which may be costly due to higher core volume.

Open flux path (e.g., air core) inductors may also be used. Simple air core designs may occupy a large volume to achieve a desired inductance, which can lead to high coil resistance and losses. Multiple layers can amplify skin and proximity effect losses and can impede cooling of inner layers. Losses often exceed acceptable levels, and the return flux path (thru surrounding air) may adversely affect nearby items. Escaping radiated fields may elevate EMI levels, and adjacent sensitive electronic circuits may respond adversely to this EMI.

SUMMARY OF THE INVENTION

According to some embodiments of the invention, an inductor includes an elongate magnetic core. A coil is wrapped around the core. A spacer separates the coil from the core to provide a coolant passage between the coil and the core. For example, the coolant passage may comprise an air passage extending substantially parallel to an axis of the core and having first and second openings proximate respective first and second ends of the core. The coil may include a twisted bundle of individually insulated conductors, which can reduce skin effect and/or proximity effect losses. The inductor may be housed in a flux-tolerant compartment, i.e., a conductive aluminum structure that supports eddy currents with acceptably low resistive losses.

In some embodiments of the invention, the spacer includes a bobbin that supports the magnetic core therein, and the coil includes a coil wrapped around the bobbin such that the bobbin separates the coil from the magnetic core to provide the coolant passage. The bobbin may include first and second interlocking frames configured to support the magnetic core therebetween. For example, the magnetic core may include a rectangular bar of magnetic material (e.g., ferrite and/or powdered iron), the first and second frames may be configured to engage respective sides of the rectangular bar of magnetic material, and the coil may be wrapped around the first and second frames.

According to further embodiments of the invention, an inductor includes an elongate magnetic core, a bobbin that retains the magnetic core therein, and a coil including a conductor wrapped in a plurality of turns around the bobbin. The bobbin positions the conductor of the coil such that a coolant passage is provided between the coil and the core. The coolant passage may comprise an air passage extending substantially parallel to an axis of the core and having first and second openings proximate respective first and second ends of the core.

In additional embodiments of the invention, an inductor includes an elongate bar of magnetic material, a bobbin configured to retain the bar of magnetic material therein, and a coil including a twisted bundle of individually insulated conductors wrapped in a plurality of turns around the bobbin. The bobbin positions the conductors of the coil such that a coolant passage is provided between the bar of magnetic material and the coil. The coolant passage may comprise an air passage extending substantially parallel to an axis of the bar of magnetic material and having first and second openings proximate respective first and second ends of the bar of magnetic material.

Potential advantages of some embodiments of the present invention include reduced core costs and lower winding cost and/or losses. Provision of a coolant passage between the core and the coil can provide better cooling and can reduce thermal coupling between the core and the coil. Use of a twisted bundle of conductors can reduce skin and proximity effect losses. Inductors according to some embodiments of the invention may be optimally paired to reduce far field intensity and enhance net inductance.

DETAILED DESCRIPTION OF EXEMPLARY EMBODIMENTS

Figure 1:
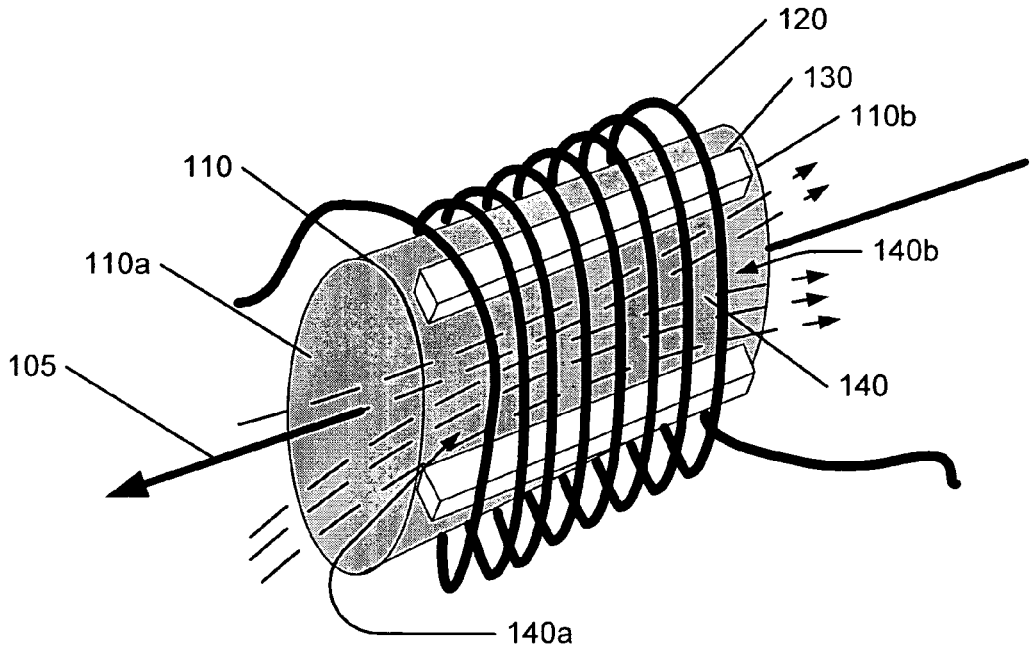
FIG. 1 illustrates an inductor according some embodiments of the present invention.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements. It will be understood that when an element is referred to as being "connected" or "coupled" to another element, it can be directly connected or coupled to the other element or intervening elements may be present.

In some embodiments of the invention, an inductor includes a core of magnetic material, such as ferrite or powdered iron. A coil is wound around the core in a solenoid configuration, and separated from the core by a gap that is sufficient to allow coolant, e.g., air, circulation along the length of the core. The coil preferably is wound using a conductor bundle including individually insulated strands that are twisted together in a substantially helical twist, i.e., without the compound twisting found in conventional Litz wire. The coil is preferably limited to one or two layers, such that each layer of the coil may be directly exposed to coolant. The inductor may be housed within a flux-tolerant compartment, e.g., a conductive aluminum housing that can reduce ohmic heating due to eddy currents generated by the inductor.

Figure 2:
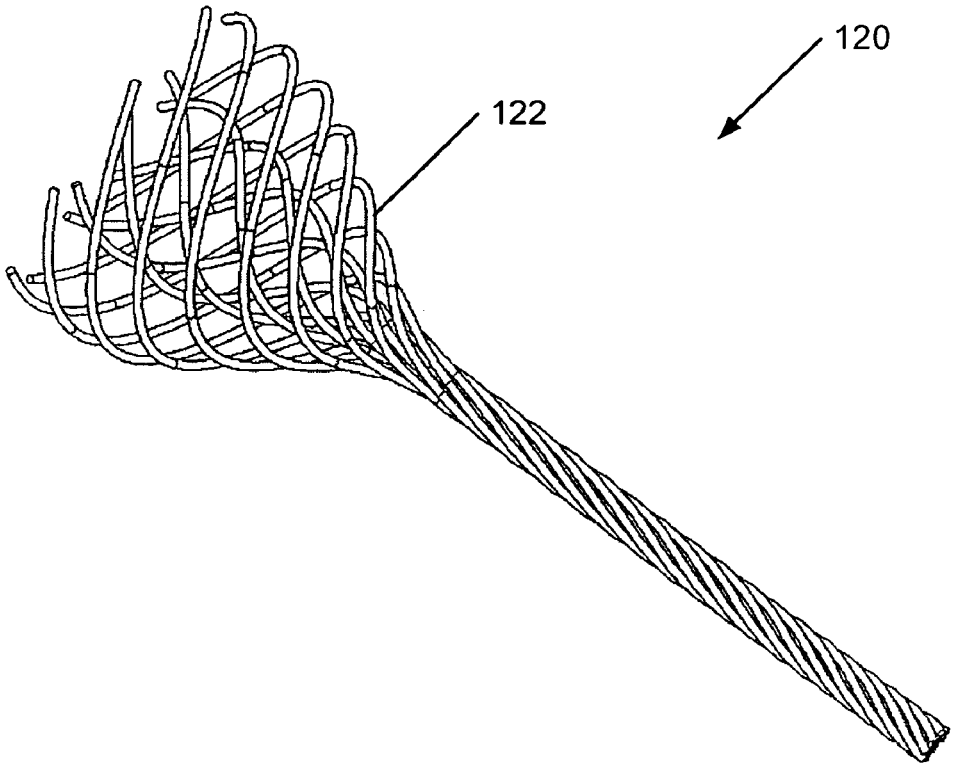
FIG. 2 illustrates a twisted conductor bundle that may be used with the inductor shown in FIG. 1.

FIG. 1 illustrates an inductor 100 according to some embodiments of the present invention. The inductor includes an elongate core 110 of magnetic material, around which is wrapped a coil 120. The coil 120 is separated from the core 110 by one or more spacers 130, thus defining a coolant passage 140 between the core 110 and the coil 120. In the illustrated embodiments, the coolant passage 140 is substantially parallel to a longitudinal axis 105 of the core and has first and second openings 140*a*, 104*b* that are proximate respective first and second ends 110*a*, 110*b* of the core 110. Such a configuration can provide, among other things, effective cooling of the core 110 and the coil 120. As shown in FIG. 2, the coil 120 may be wound using a twisted bundle of individually insulated conductors 122. Such conductors 122 may be twisted together in, for example, a simple helical fashion.

Figure 3:
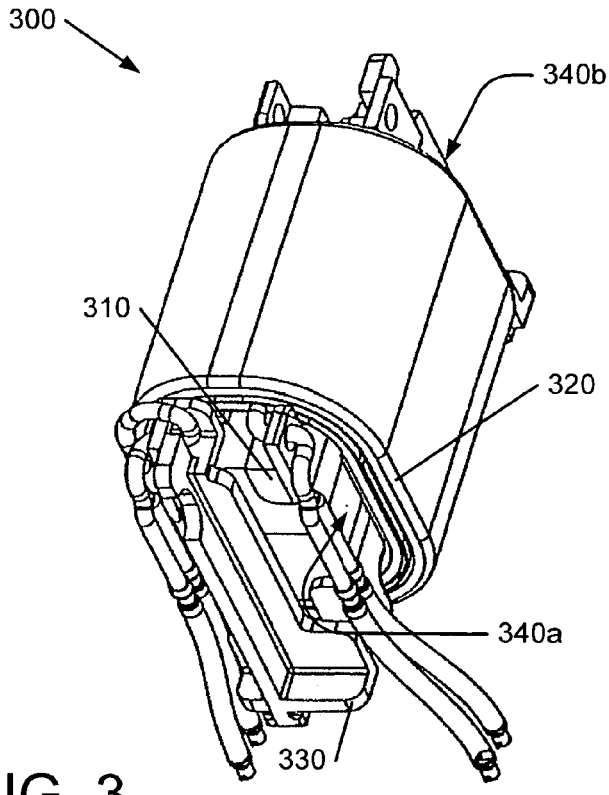
FIGS. 3–5 are perspective, end and exploded views, respectively, of an inductor according to further embodiments of the invention.
Figure 4:
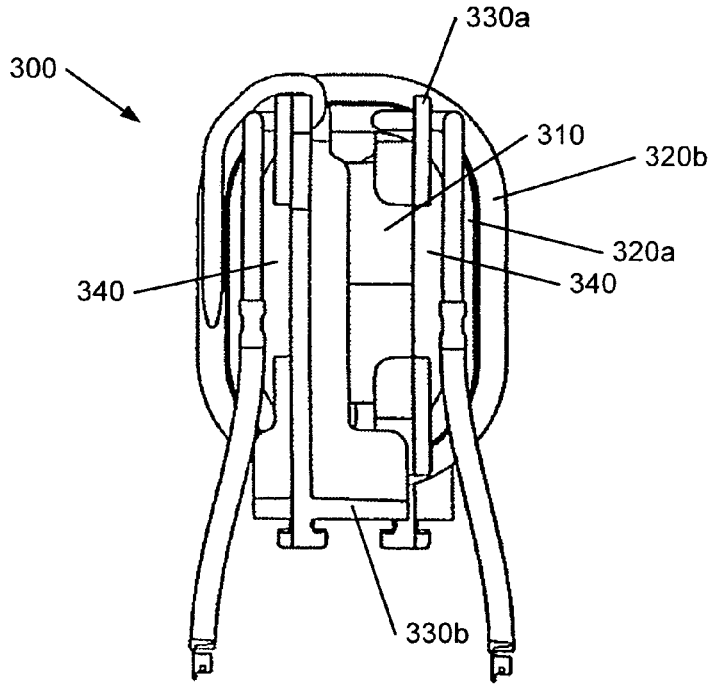
Figure 5:
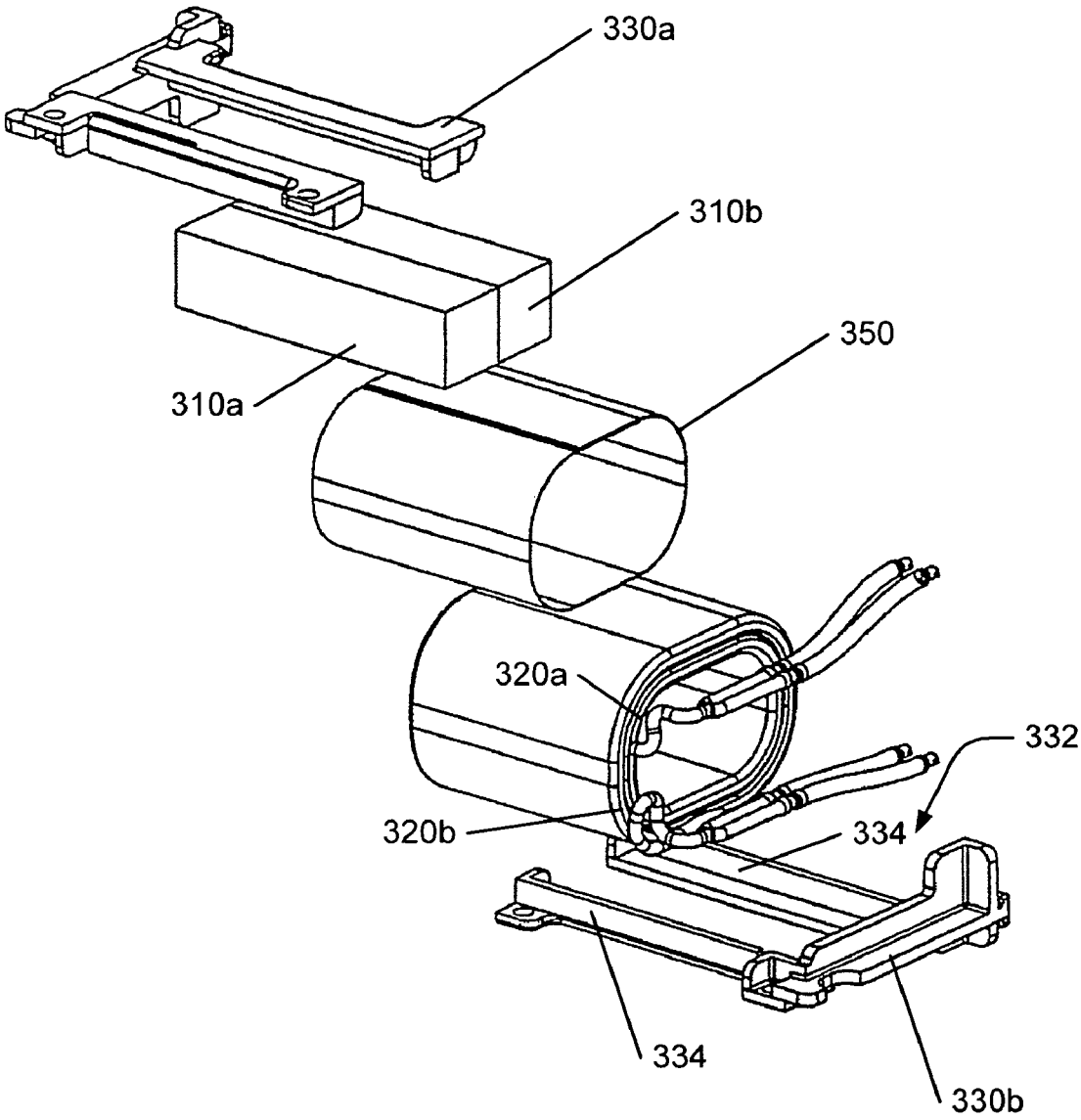

According to various embodiments of the invention, core, coil and spacer structures may each take various physical configurations. For example, an inductor may have a core with a cylindrical, rectangular, ellipsoidal, or other form. The spacer may have any of a number of different shapes other than the bar-like shape shown in FIG. 1. For example, as shown in FIGS. 3–5, the spacer may include a bobbin structure that retains a magnetic core and provides a framework upon which the coil may be supported, spaced apart from the core to provide a coolant passage along the lines illustrated in FIG. 1. Such a bobbin structure may also facilitate mounting.

FIGS. 3–5 illustrate an inductor 300 according further embodiments of the invention. The inductor 300 includes a core in the form of a rectangular bar 310 of magnetic material (e.g., ferrite, powdered iron, or the like), around which is wrapped a coil 320, which includes series-connected first and second overlapping coils 320*a*, 320*b*. The coil 320 is supported by a bobbin 330, which includes interlocking first and second plastic frames 330*a*, 330*b* that are configured to engage respective first and second sides of the bar 310 such that the bar 310 is retained within the bobbin 330. The Bobbin 330 holds the coil 320 off the bar 310 such that coolant (e.g., air) passages 340 are provided between the sides of the bar 310 and the coil 320.

Referring to the exploded view in FIG. 5, layers 320*a*, 320*b* of the coil 320 are separated by an insulating sleeve 350, and the bar 310 is formed from first and second pieces 310*a*, 310*b*. Each of the frames 330*a*, 330*b* includes a receptacle 332 portion bound by ribs 334 that are configured to engage edges of the bar 310. The frames 330*a*, 330*b* also include mounting feet 336 that are configured to engage slots in a sheet metal panel or similar surface to provide mounting of the inductor 300.

In an exemplary inductor having the configuration illustrated in FIGS. 3–5, the core 310 is formed from two 1 inch×1 inch by 4 inch ferrite bars (3C81, 3C90, 7099, or equivalent material) glued together to form a 1 inch×2 inch by 4 inch ferrite bar (alternatively, the core 310 may be a single piece of such material). The core 320 includes two substantially concentric and overlapping series-connected coils formed from a twisted bundle of 24 strands of individually insulated #20 AWG copper wire. The wires in the bundle are twisted approximately 0.5 turns per inch (e.g., 0.5±0.1 turns per inch). This inductor provides an inductance of approximately 100 microhenrys (100 microhenrys±10% at 10 kHz), a DC resistance of approximately 9 milliohms (at 25° C.) and an equivalent series resistance (ESR) at 12.5 kHz of approximately 75 milliohms.

Figure 6:
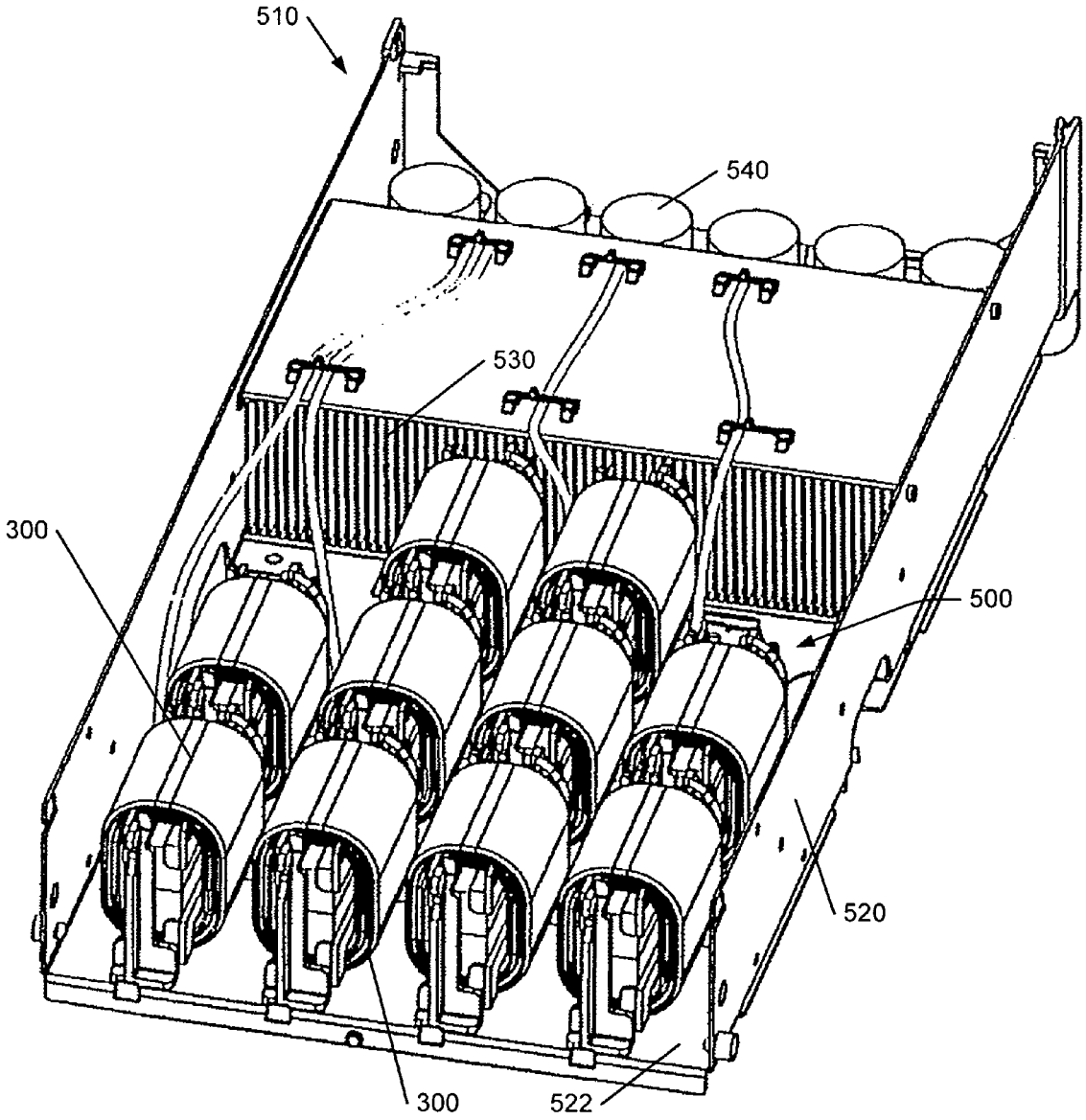
FIG. 6 is a perspective view illustrating inductors mounted in a flux tolerant compartment provided in a UPS power converter module according to further embodiments of the invention.

FIG. 6 shows an example of a conductive flux tolerant compartment 500 in which one or more inductors 300 as illustrated in FIGS. 3–5 may be housed according to further embodiments of the invention. In particular, the compartment 500 is provided within a power conversion module 510 used in an uninterruptible power supply (UPS). The module 510 includes an aluminum housing 520 having a surface 522 upon which the inductors 300 are mounted. Module 510 further includes a conductive aluminum heat sink 530 that provides cooling for a power transistor assembly (not shown) included in the module 510. The flux tolerant compartment 500, thus, includes the space bounded by a conductive structure that includes the housing 520 and the heat sink 530. In some UPS configurations, the compartment 500 may be further enclosed by a conductive aluminum cover (not shown) configured to mount on the housing 520 over the inductors 300. In other configurations, the compartment 500 may be further enclosed by another module (not shown) mounted facing the module 510. Additional adjacent structures of the module 510, such as cases of capacitors 540, are also formed of conductive aluminum. Because the compartment 500 is relatively highly conductive, it can support eddy currents produced by the inductors 300 without undue resistive heating.

Figure 7:
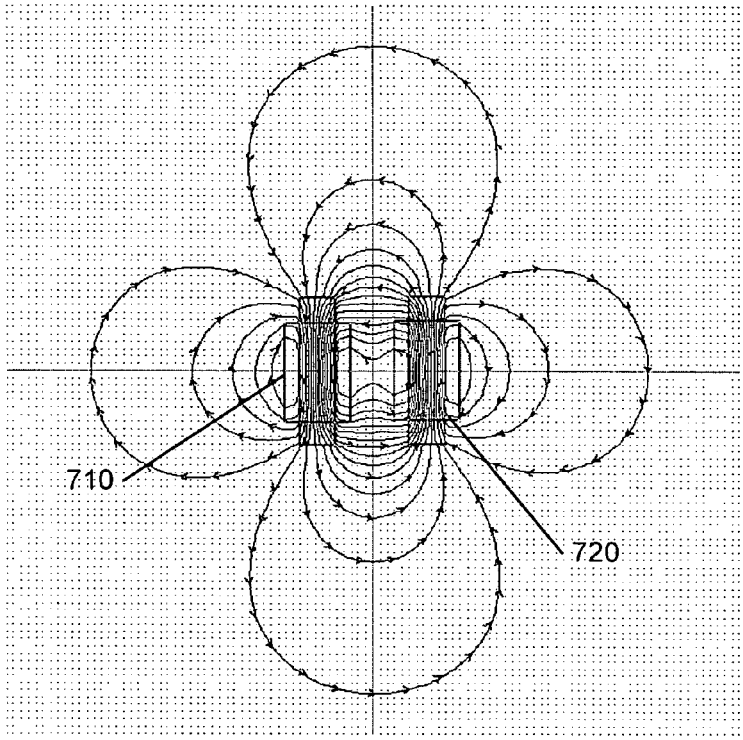
FIGS. 7 and 8 are diagrams illustrating exemplary simulated magnetic flux distributions for inductors according to some embodiments of the invention.
Figure 8:
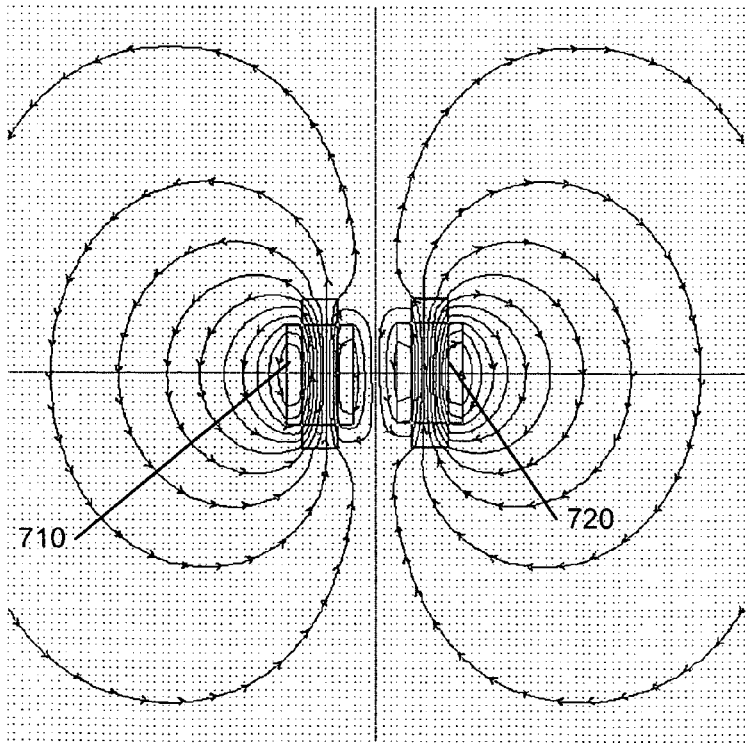

In applications in which multiple inductors such as the inductor 300 are used, flux linkage from the inductors to surrounding structures can also be reduced by mounting the inductors such that their flux paths cancel, which can reduce "far field" flux and resultant eddy current heating. FIG. 7 illustrate simulated flux distributions for first and second inductors 710, 720 oriented such that their far fields substantially cancel and their near fields are mutually enhanced, while FIG. 8 shows the same inductors 710, 720 oriented in an opposite fashion, i.e., such that their far fields do not substantially cancel.

Potential advantages offered by various embodiments of the present invention include reduced core costs. The number of turns and mean length per turn can also be reduced, which can lower winding cost and losses. Use of a flux tolerant compartment can minimize or eliminate issues associated with stray return flux. Provision of a coolant passage between the core and the coil can provide better cooling and can reduce thermal coupling between the core and the coil. Use of a low loss core material, such as ferrite, can further reduce core losses and, thereby, temperatures. Use of twisted conductors (i.e., "poor man's Litz wire") can significantly reduce skin and proximity effect losses at potentially lower cost than conventional Litz wire. Limiting number of winding layers to 1 or 2 layers can provide direct cooling to every layer and can reduce proximity effect losses. Use of an oval/rectangular core/coil shape can facilitate better fit in available space and make use of standard core sizes/shapes (traditional shape is square/round for max area/circumference).

In the drawings and specification, there have been disclosed exemplary embodiments of the invention. Although specific terms are employed, they are used in a generic and descriptive sense only and not for purposes of limitation, the scope of the invention being defined by the following claims.

That which is claimed:

1. An inductor, comprising:

an elongate magnetic core;

a coil wrapped around the core; and a spacer that separates the coil from the core to provide a coolant passage between the coil and the core that exposes a surface of the core, wherein the spacer comprises a bobbin comprising first and second interlocking frames configured to support the magnetic core therebetween and wherein the coil comprises a coil wrapped around the bobbin such that the bobbin separates the coil from the magnetic core to provide the coolant passage.

2. An inductor according to claim 1, wherein magnetic core comprises a rectangular bar of magnetic material, wherein the first and second frames are configured to engage respective sides of the rectangular bar of magnetic material, and wherein the coil is wrapped around the first and second frames.

3. An inductor according to claim 1, wherein the coil comprises only one or two layers of coils on the bobbin.

4. An inductor according to claim 3, wherein the coil comprises:

a first coil wound around the bobbin; and a second coil wound around the first coil and electrically coupled in series with the first coil.

5. An inductor according to claim 4, further comprising an insulating sleeve interposed between the first and second coils.

6. An inductor according to claim 3, wherein the first coil is immediately adjacent the coolant passage.

7. An inductor according to claim 1, wherein the coil comprises a bundle of individually insulated conductors twisted in a substantially helical fashion.

8. An inductor according to claim 1, wherein the magnetic core comprises a ferrite material.

9. An inductor according to claim 1 housed in a flux-tolerant compartment.

10. An inductor according to claim 9, wherein the flux-tolerant compartment comprises a conductive sheet metal housing at least partially enclosing the inductor.

* * * * *